United States Patent [19]

Yoshioka

[11] Patent Number: 4,632,045

[45] Date of Patent: Dec. 30, 1986

[54] SLIDER-MOVING UNIT IN APPARATUS FOR SEWING A SLIDE FASTENER TO A PAIR OF FABRIC PIECES

[75] Inventor: Hiroshi Yoshioka, Namerikawa, Japan

[73] Assignee: Yoshida Kogyo K. K., Tokyo, Japan

[21] Appl. No.: 837,602

[22] Filed: Mar. 7, 1986

[30] Foreign Application Priority Data

Mar. 8, 1985 [JP] Japan ..... 60-46118

[51] Int. Cl.[4] ..... D05B 3/12; D05B 23/00

[52] U.S. Cl. ..... 112/104; 112/121.27

[58] Field of Search ..... 112/104, 121.26, 121.27, 112/121.12, 121.15, 113, 152, 265.2

[56] References Cited

U.S. PATENT DOCUMENTS 3,710,745 1/1973 Yoshikawa ..... 112/265.2
4,006,695 2/1977 Van Amburg ..... 112/104
4,274,347 6/1981 Rohrer ..... 112/104
4,497,270 2/1985 Boser ..... 112/104 X
4,541,352 9/1985 Boser et al. ..... 112/121.27 X

*Primary Examiner*—H. Hampton Hunter
*Attorney, Agent, or Firm*—Hill, Van Santen, Steadman & Simpson

[57] ABSTRACT

An apparatus for sewing a slide fastener to a pair of fabric pieces is provided with a slider-moving unit for coupling a pair of opposed stringers of the slide fastener immediately after the opposed stringers have been sewn to the respective fabric pieces. The slider-moving unit includes a slider-holding mechanism disposed downstream of a sewing station and reciprocable for pulling a slider on the slide fastener away from the sewing station, and a brake disposed adjacent to an upstream end of the reciprocating movement of the slider-holding mechanism for retaining a bottom end of the slide fastener while the slider is being pulled by the slider-holding mechanism.

2 Claims, 20 Drawing Figures

SLIDER-MOVING UNIT IN APPARATUS FOR SEWING A SLIDE FASTENER TO A PAIR OF FABRIC PIECES

BACKGROUND OF THE INVENTION

1. Field of the Invention

The present invention relates to an apparatus for sewing a slide fastener to a pair of fabric pieces, such as of a curtain, a tent or a lady's dress. More particularly the invention relates to a unit for moving a slider to close the slide fastener sewn to the fabric pieces.

2. Description of the Prior Art

Conventionally, in attaching a slide fastener to a pair of fabric pieces on a sewing machine, it has been customary that the slide fastener and the pair of fabric pieces are manually supplied to a sewing station in timed relation to each other. Because of this manual supplying, precise and efficient sewing operation cannot be achieved.

To this end, an improved apparatus has been proposed in Boser application for U.S. Pat., Ser. No. 535 729 filed Sept. 26, 1983, now U.S. Pat. No. 4,497,270, issued Feb. 5, 1985 for enabling automatic sewing that avoids operator's handling during the sewing operation and affords a controlled set-up and running of the sewing operation. Thus precise and efficient sewing can be achieved regardless of operator's experience or skill. However, since the sewn products are discharged with the opposed stringers of the individual slide fastener uncoupled, the prior apparatus causes a problem in that the sewn products assume disordered postures while they are being collected and transported.

SUMMARY OF THE INVENTION

It is therefore an object of the present invention to provide a slider-moving unit for coupling the opposed stringers of a slide fastener immediately after the latter has been sewn to a pair of fabric pieces in a sewing machine. With the individual slide fastener closed, the sewn products can be discharged in order, thus facilitating collection and transportion of the products.

According to the present invention, an apparatus for sewing a slide fastener to a pair of fabric pieces has a slider-moving unit for coupling a pair of opposed stringers of the slide fastener immediately after the opposed stringers have been sewn to the respective fabric pieces. The slider-moving unit includes a slider-holding mechanism disposed downstream of a sewing station and reciprocable for pulling a slider of the slide fastener away from the sewing station, and a brake disposed adjacent to an upstream end of the reciprocating movement of the slider-holding mechanism for retaining a bottom end of the slide fastener while the slider is being pulled by the slider-holding mechanism.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
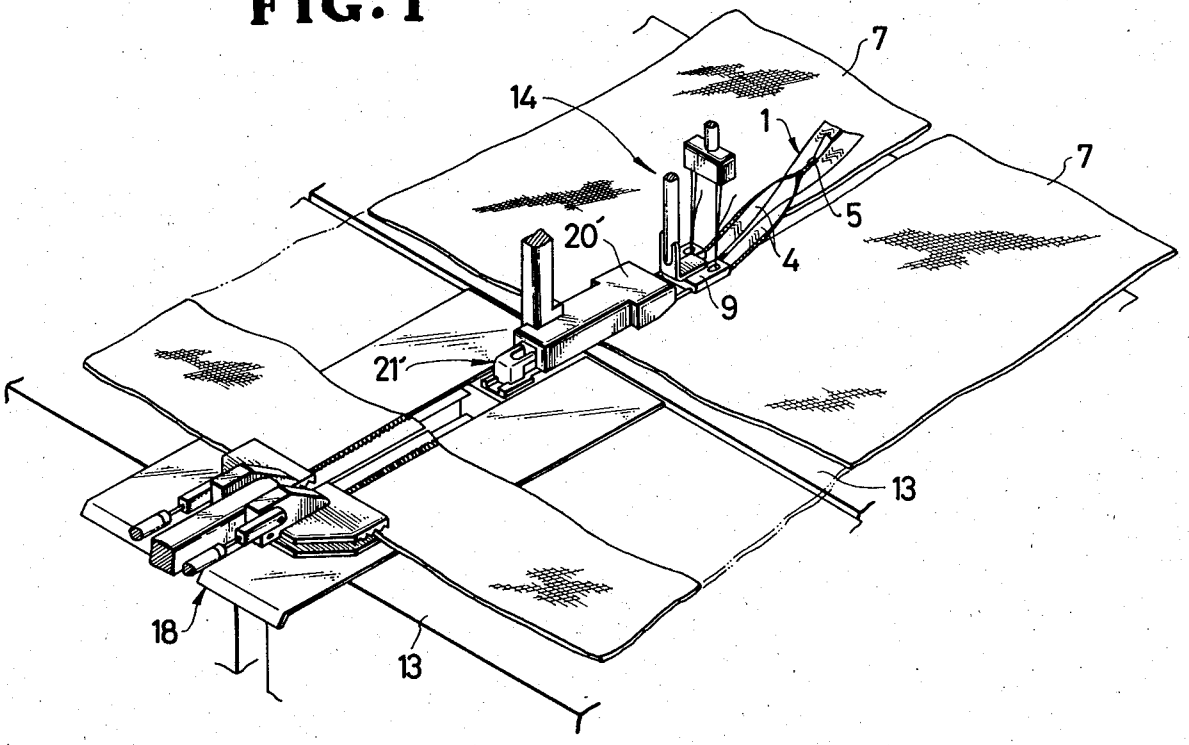
FIG. 1 is a fragmentary perspective view of a sewing apparatus having a slider-moving unit embodying the present invention.
Figure 2:
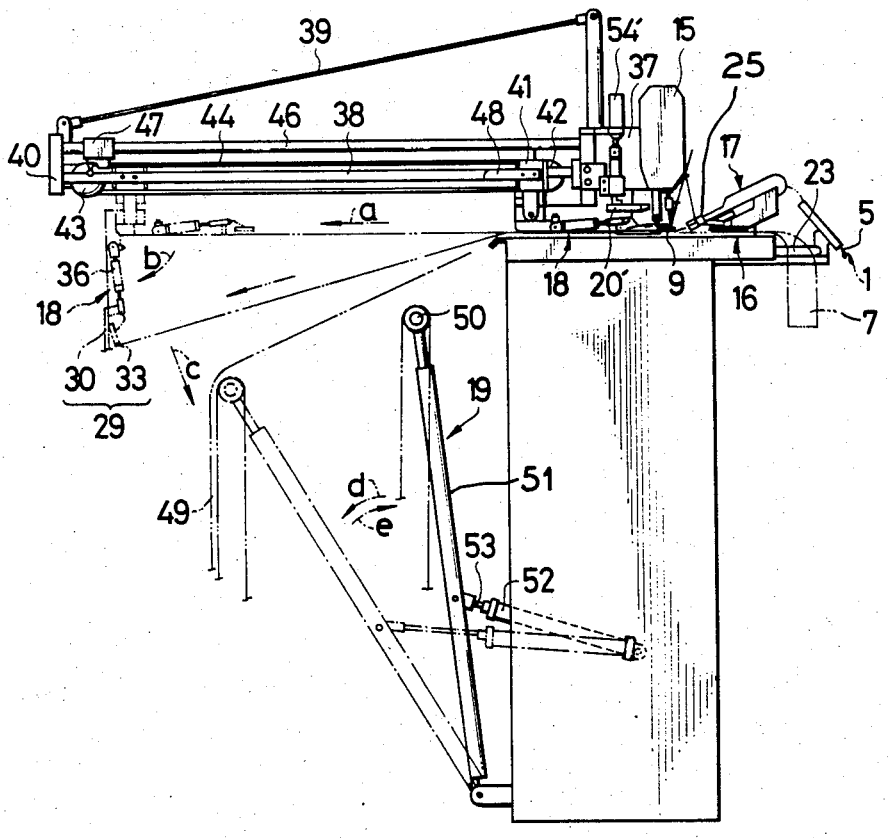
FIG. 2 is a front elevational view, on a reduced scale, of FIG. 1.
Figure 3:
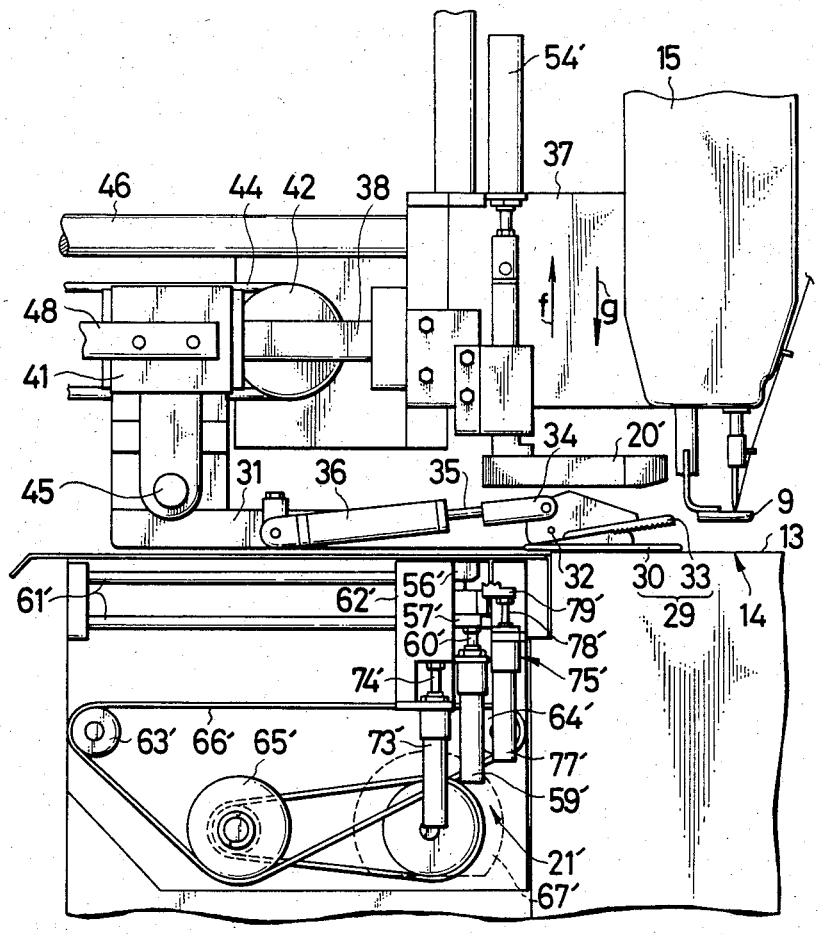
FIG. 3 is an enlarged front elevational view, with parts omitted, of the apparatus, showing the slider-moving unit in detail.
Figure 4:
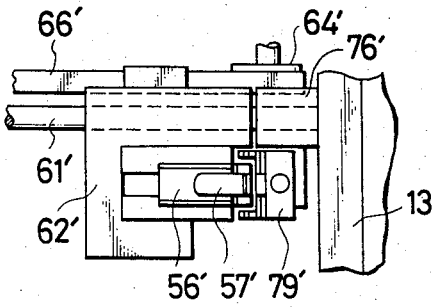
FIG. 4 is an enlarged, fragmentary plan view of the slider-moving unit of FIG. 3.

FIGS. 1 through 3 show an apparatus for sewing a slide fastener 1 to a pair of fabric pieces 7, 7.

The apparatus generally comprises a table 13, a sewing machine 15 mounted centrally on the table 13 and defining a sewing station 14, a fabric guide 16 (FIG. 2) supported on the table 13 upstream of the sewing station 14, a slide-fastener guide 17 (FIG. 2) supported on the table 13 and disposed above the fabric guide 16, a gripper mechanism 18 mounted on the table 13 downstream of the sewing station 14 for horizontal linear movement, a stacker 19 disposed beneath the gripper mechanism 18, a sewn-product guide 20' disposed downstream of the sewing station 14 for vertical movement, and a slider-moving unit 21' (FIGS. 1 and 3) disposed beneath the sewn-product guide 20' for horizontal linear movement.

The sewing machine 15 may be a conventional type on the market. It includes a presser foot 9, a pair of feed dogs (not shown), and a pair of sewing needles. Upon depression of a start button (not shown), the presser foot 9 is lowered and then the sewing of the slide fastener 1 and the fabric pieces 7, 7 in "lock stitch" takes place. This lock-stitch sewing is followed by back-tucking, cutting the sewing threads and raising the presser foot 9 in this order. The details of the sewing machine 15 itself are not pertinent here and its detailed description is omitted for clarity.

As shown in FIG. 2, the fabric guide 16 includes a pair of transparent horizontal guide plates (only one shown) spaced from the upper surface of the table 13 by a gap substantially equal to the thickness of the individual fabric piece 7, and a pair of guide rods 23, 23 (only one shown) mounted on the front or upstream side of the table 13. As the pair of fabric pieces 7, 7 are supplied to the sewing station 14, each fabric piece 7 is supported on the respective guide rod 23 and is then introduced into the gap between the corresponding guide plate and the table 13.

The slide-fastener guide 17 includes an elongated flanged guiding plate sloping downwardly toward the sewing station 14 and an elongated flanged auxiliary guiding plate disposed upstream of the guiding plate, for guiding the substantially uncoupled stringers 4, 4 over the two guiding plates. The slide-fastener guide 17 also includes a pair of spaced track bodies 25 (only one shown) mounted on the guiding plate at one end thereof adjacent to the sewing station 14 for guiding the respective coupling element rows in such a manner, that each coupling element row assumes an erected position as shown in FIG. 1.

The purposes of the gripper mechanism 18 are to keep the tension of both the slide fastener 1 and the fabric pieces 7, 7 to a constant degree during the sewing, thus not only causing a uniform rate of sewing but also making the sewn stitches 12, 12 (FIGS. 9A and 9B) aligned with the respective folding lines of the opposed stringers 4, 4. The guide mechanism 18 also serves to quickly discharge the sewn product, namely, the slide fastener 1 with the fabric pieces sewn thereto.

As shown in FIGS. 1-3, the gripper mechanism 18 includes a pair of laterally spaced grippers 29, 29, each gripper 29 being composed of an upper grip member 33 and a lower grip member 30. The lower grip member 30 is secured to a horizontal connector 31 and is disposed slightly above the top surface of the table 13. The upper grip member 33 is pivotally connected to the connector 31 near the downstream end of the lower grip member 30 by a pin 32. The upper grip member 33 is also connected to an air cylinder 36 via a link 34 which is connected to a piston rod 35 of the air cylinder 36. The two air cylinders 36,36 are pivotally mounted on the connector 31 remotely from the grippers 29, 29. Upon energization or de-energization of the two air cylinders 36, 36, each piston rod 35 projects or is retracted to close or open the respective gripper 29.

Fixedly secured to the downstream side of the sewing machine 15 is a holder 37 from which a guide rail 38 extends horizontally in the direction of discharging the sewn product. A distal end of the guide rail 38 is fixedly secured to a bracket 40 supported by a hanger rod 39, as shown in FIG. 2. A slide 41 is slidably mounted on the guide rail 38. As shown in FIGS. 2 and 3, an endless belt 44 is wound about a pair of pulleys 42, 43 rotatably mounted on the holder 37 and the bracket 40, respectively, the endless belt 44 being fixedly secured to the slide 41. The pulley 42 is connected to a servo motor (not shown) which drives the slide 41 selectively forwardly (downstream) and backwardly (upstream) and which changes the rate of movement of the slide 41 depending on the load. The downstream end of the connector 31 of the gripper mechanism 18 is integrally connected to a transverse shaft 45 rotatably supported by the slide 41.

The backward or upstream movement of the slide 41 is limited by a stop (not shown) projecting therefrom and engageable with the holder 37; thus the backward movement of the two grippers 29, 29 terminates in a retracted position close to the sewing station 14. At that time, the approach of the slide 14 is detected by a proximity switch (not shown) which issues a signal to reduce the rate of rotation of the non-illustrated servo motor, and the arrival of the slide 41 is detected by a limit switch (not shown) which has an actuator engageable with the non-illustrated stop and which is responsive to this engagement to issue a signal to terminate the rotation of the non-illustrated servo motor.

The forward or downstream movement of the slide 41 is limited by a contact member 48 extending therefrom and engageable with an actuator of a microswitch 47 which is adjustably mounted on a support rod 46 extending between the holder 37 and the bracket 40 in parallel relationship to the guide rail 38. Upon its actuation, the microswitch 47 produces a signal to stop the rotation of the servo motor, thus terminating the forward movement of the slide 41. As a result, the forward movement of the two grippers 29, 29 terminates in an advanced position, which is adjustable by changing the position of the microswitch 47 on the support rod 46.

The transverse shaft 45 is operatively connected to a drive, such as a motor or an air cylinder, for turning the transverse shaft 45 through a predetermined angle about its axis. In response to clockwise turning of the transverse shaft 45, the connector 31 of the gripper mechanism 18 is angularly movable about the transverse shaft 45 in the direction of an arrow b from the horizontal position to the vertical position, as shown in FIG. 2. This arrangement is particularly useful when a relatively long sewn product is to be discharged without elongating the guide rail 38.

As shown in FIG. 2, the stacker 19 is disposed beneath the gripper mechanism 18 for receiving the successive sewn product 49 (released from the gripper mechanism 18 as described below) one over another and for discharging a stack of the sewn products 49 out of the apparatus when the stack feaches a predetermined amount.

The stacker 19 includes a generally T-shaped hanger having a horizontal pipe 50 connected to an upper end of an arm 51 pivotally mounted on a base beneath the table 13. An air cylinder 52 is pivotally supported by the base, and a pistion rod 53 of the air cylinder 52 is pivotally connected to the arm 51 at a midportion thereof. In timed relation to the forward movement of the two grippers 29, 29, the piston rod 53 of the air cylinder 52 projects to cause the stacker 19 to pivotally move in the direction of an arrow d in FIG. 2 from a retracted position (solid lines) to an advanced position (dash-and-dot lines) where the sewn product 49 released from the grippers 29, 29 is received on the transverse pipe 50. Thereafter, when the piston rod 53 of the air cylinder 52 is retracted, the stacker 19 is returned in the direction of an arrow e in FIG. 2 to its original or retracted position, with the sewn product 49 hanging on the transverse pipe 50.

Figure 7A:
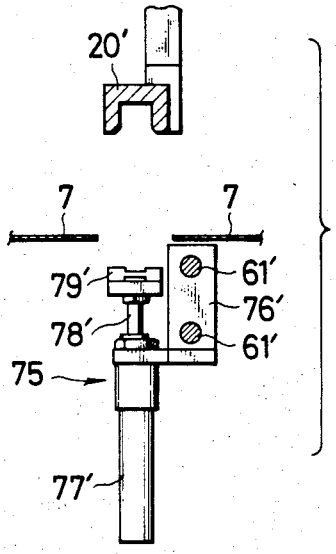
FIGS. 7A to 7C are side elevational views, on a reduced scale and partially in cross section, of FIGS. 4 and 5, illustrating the operation of a brake.
Figure 7B:
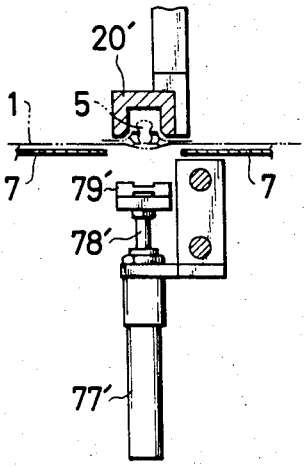
Figure 7C:
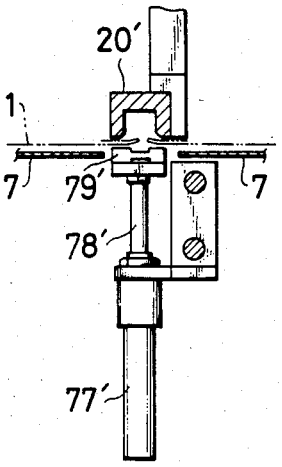
Figure 8A:
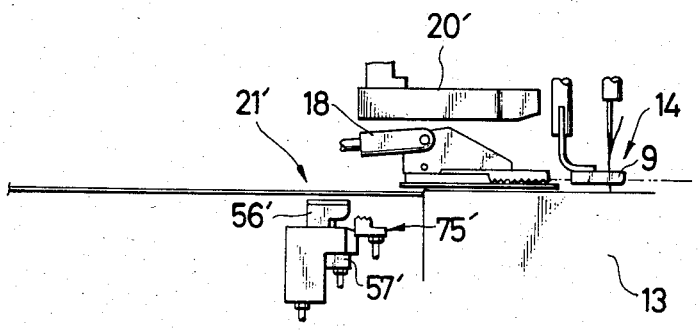
FIGS. 8A to 8E are schematic side elevational views of the apparatus, illustrating the sequence of steps of operation of the slider-moving unit.

As shown in FIGS. 1 and 3, the sewn-product guide 20' is disposed downstream of the sewing station 14 and is vertically movable in the direction of arrows f, g by means of an air cylinder 54' supported by the holder 37. The sewn-product guide 20', as shown in FIGS. 7A-7C has a downwardly opening guide channel. When the sewn product 49 (FIGS. 2 and 9A) is pulled forwardly by the gripper mechanism 18, the sewn-product guide 20' is lowered from the position of FIGS. 7A and 8A to the position of FIGS. 7B and 8B and then the slider 5 (disposed at the lower end portion of the sewn product 49) is guided along the guide channel of the sewn-product guide 20' to the slider-moving unit 21'. While the slide fastener 1 is being sewn to the pair of fabric pieces 7, 7, the guide 20' is in raised position, as shown in FIGS. 2 and 8A, so as not to obstruct the movement of the gripper mechanism 18.

As shown in FIGS. 1 and 3, the slider-moving unit 21' includes a slider-holding mechanism disposed immediately downstream of the sewn-product guide 20' for horizontal linear movement for pulling the slider 5 from the bottom end stop (not shown) of the sewn slide fastener 1 (FIG. 9A) toward the top end stops (not shown) to thereby couple the opposed stringers 4,4 through a predetermined length. As a result, the slider 5 has been moved to the regions where the slide fastener 1 is sewn-,to the fabric pieces 7,7.

The partly closed product 49 (FIG. 9B) is discharged out of the apparatus, and then the slider 5 can be moved all the way to the top end stops (not shown) of the slide fastener 1 smoothly to provide a fully closed slide fastener (not shown) sewn to a pair of fabric pieces 7,7. The party closed products 49 can be discharged in ordered postures, thus facilitating their collection and transportation.

As better shown in FIGS. 4, 5 and 6A–6C, the slider-holding mechanism includesa slider catch 56' for receiving the slider 5, and a retainer 57' for retaining the slider 5 in the catch 56'. The slider catch 56' is mounted on a piston rod 74' of a first vertical air cylinder 73' fixedly secured to a lower portion of a slide 62', while the retainer 57' is mounted on a piston rod 60' of a second vertical air cylinder 59' fixedly secured to a lower portion of the catch 56'. The slide 62' is slidably mounted on a pair of vertically spaced horizontal guide rails 61',61' which is supported by the base (of the apparatus) beneath the table 13.

Figure 6A:
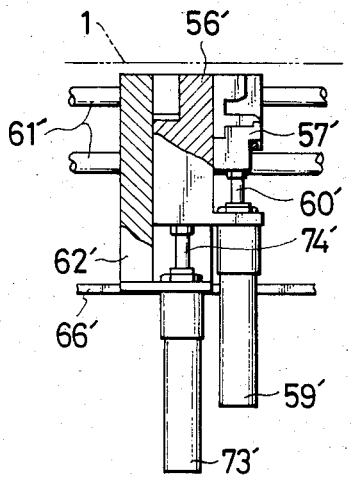
FIGS. 6A to 6C are front elevational views, on a reduced scale and partially in cross section, of FIGS. 4 and 5, illustrating the operation of a slider-holding mechanism.
Figure 6B:
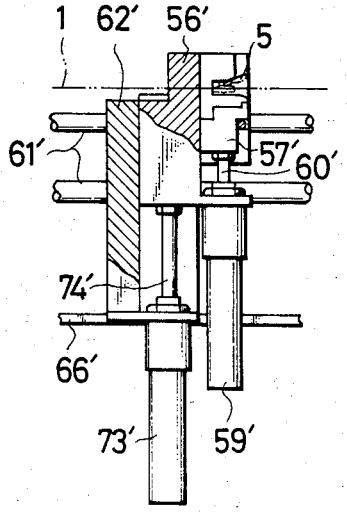

As the piston rod 74' of the first air cylinder 73' is extended, the catch 56' is moved upwardly on the slide 62' from the position of FIG. 6A to the position of FIG. 6B to receive the slider 5. At that time the second air cylinder 59', with its piston rod 60' and hence the retainer 57' retracted, is moved upwardly along with the catch 56'. Then as the piston rod 60' of the second air cylinder 59' is extended, the retainer 57' is raised from the position of FIG. 6B to the position of FIG. 6C to press the slider 5 against the catch 56', thus preventing the slider 5 from being removed from the catch 56'.

As shown in FIG. 3, an endless belt 66' is wound around a pair of small-sized upper pulleys 63', 64' and a large-sized lower pulley 65' and is fixedly secured to the slide 62', all the pulleys 63', 64', 65' being rotatable on the base of the apparatus. The two small-sized pulleys 63', 64' are disposed below the two guide rails 61', 61' and are spaced away from each other along the guide rails, 61', 61', while the large-sized pulley 65' is disposed further below the guide rails 61',61'.

The large-sized pulley 65' is operatively connected to a drive 67', such as a rotary actuator, for rotation in opposite directions. As the large-sized pulley 65' is driven by the drive 67' for counterclockwise rotation, the slide 62' is moved forwardly (leftwardly) away from the sewing station 14 along the guide rails 61',61'. Reversely, as the large-sized pulley 65' is rotated clockwise, the slide 62' is then moved backwardly (rightwardly) toward the sewing station 14 along the guide rails 61',61'.

The slider catch 56', along with the retainer 57', is reciprocable, in response to the reciprocating movement of the slide 62', for pulling the slider 5 forwardly along the opposed stringers 4, 4 to close the slide fastener 1 of the sewn product 49 while the opposite end of the slide fastener 1 is held in position in a manner described below.

Figure 6C:
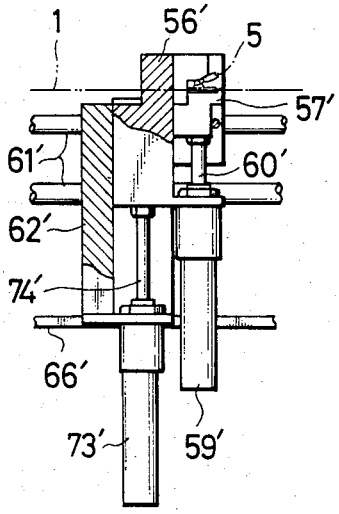

As the piston rod 74' of the first air cylinder 73' is retracted, the catch 56' is moved downwardly from the position of FIG. 6C to the position of FIG. 6A below the table 13 so as not to impede not only the movement of gripper mechanism 18 but the discharging of the sewn product 49. Reversely, as the piston rod 74' of the first air cylinder 73' is extended, the catch 56' is moved upwardly from the position of FIG. 6A to the position of FIG. 6B to project above the top surface of the table 13. The slider 5 is received in the catch 56' and is then retained therein by the retainer 57' (FIG. 6C), whereupon the forward (leftward) movement of the catch 56' is started.

Figure 5:
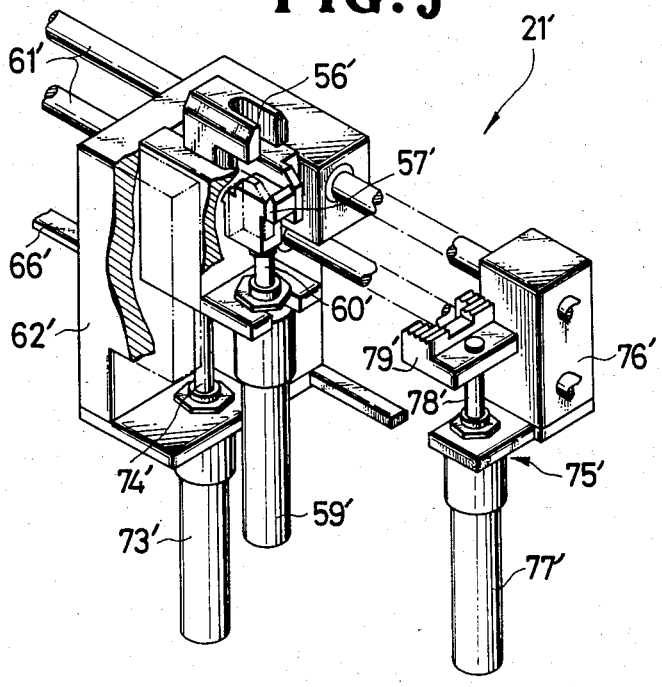
FIG. 5 is an enlarged perspective view, with parts broken away, of the slider-moving unit.

As shown in FIGS. 3 and 5 the slider-moving unit 21' also includes a brake 75' supported on the guide rails 61',61' at a fixed position adjacent to their upstream ends to temporarily stop the forward movement of the sewn product 49 to thereby facilitate the forward movement of the slider 5 on the slide fastener 1 by the slider-holding mechanism, namely, the catch 56' and the retainer 57'.

As shown in FIGS. 3–5 and 7A–7C, the brake 75' includes a bracket 76' fixed to the guide rails 61', 61', a third vertical air cylinder 77' supported by the bracket 76', and a pressing member 79' mounted on a piston rod 78' of the third air cylinder 77'. As the piston rod 78' of the third air cylinder 77' is extended, the pressing member 79' is raised from the position of FIGS. 7A and 7B to the position of FIG. 7C for pressing the bottom end portion of the slide fastener 1 against the lower surface of the sewn-product guide 20'. Reversely, as the piston rod 78' of the third air cylinder 77' is retracted, the pressing member 79' is returned to its original or lowered position (FIG. 7A) for releasing the sewn product 49.

The manner in which an ordinary slide fastener 1 is sewn to a pair of fabric pieces 7,7 on the apparatus of FIGS. 1–5, 6A–6C and 7A–7C will be described hereinbelow in connection with FIGS. 8A–8E.

Before starting the sewing work, a pair of fabric pieces 7,7 (FIGS. 1 and 2) is introduced into the sewing station 14, and a slide fastener 1 is fully opened by moving the slider 5 and then the uncoupled stringers 4,4 are turned upside down through the entire length of the side fastener 1 except the bottom end portion thereof. Thus the two turned stringers 4,4 assume twisted positions in mirror symmetry. The slide fastener 1 is introduced into the sewing station 14, with the opposed stringers 4,4 superimposed over the respective fabric pieces 7,7.

More specifically, in introducing the fabric pieces 7,7 into the sewing station 14, each fabric piece 7 passes over the respective guide rod 23 and then through the gap between the corresponding guide plate and the upper surface of the table 13. On the other hand, the slide fastener 1 is opened manually and is then placed over the guide plate while turning the uncoupled stringers 4,4 upside down. Then the leading end portion of each stringer 4 is introduced into the sewing station 14 via the respective track body 25. In the sewing station 14, the leading end portion of each stringer 4 is superimposed over the respective fabric piece 7 in such a manner that the coupling elements 3 are erected with the head portions thereof directed downwardly. At that time, as shown in FIG. 3, the gripper mechanism 18 is disposed at a position near the presser foot 9 in the sewing station 14, with each gripper 29 open. The sewn-product guide 20' is in raised position so as not to interfere with the gripper mechanism 18, as shown in FIG. 3. The slide-moving unit 21' is in retracted position near the sewing station 14, the slider catch 56' being retracted below the table 13.

When a start button (not shown) is depressed, the presser foot 9 and the sewing needles are lowered to start sewing work. As the sewing work progresses, both the leading end portion of each fabric piece 7 and the leading end portion of the corresponding stringer 4 are advanced between the upper and lower grip members 33, 30 of the respective gripper 29. The arrival of the leading ends of the fabric pieces 7,7 and the stringers 4,4 is detected by a photosensor (not shown) disposed at a suitable position in the sewing station 14. The photosensor is responsive to this arrival to issue a command signal to the air cylinder 36, whereupon the piston rod 35 of the air cylinder 36 is extended to cause each gripper 29 to grip the superimposed end portions of the respective fabric piece 7 and the corresponding stringer 4, as shown in FIG. 8A. The grippers 29 pull the sewn product 49 forwardly to discharge the same from the sewing station 14 under a constant tension smaller than the tension under which the sewn product 49 is advanced by the feed dog (not shown) of the sewing machine 15. This discharging tension is automatically controlled by the non-illustrated servo motor that is the drive source for moving the slide 41 of the gripper mechanism 18.

Figure 8B:
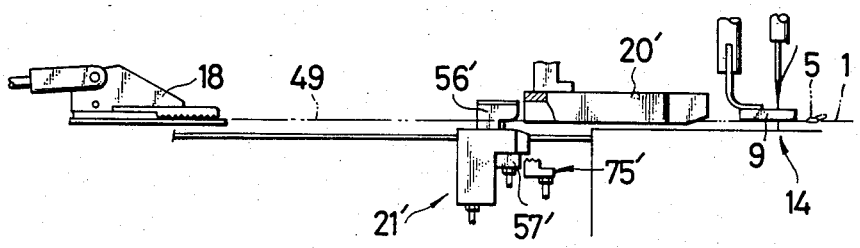

When the grippers 29,29, as the sewing work further progresses, are removed from the region where both the sewn-product guide 20' and the slider-moving unit 21' are located, the sewn-product guide 20' is lowered and the slider catch 56' of the slider-moving unit 21' projects above the upper surface of the table 13, as shown in FIG. 8B.

Figure 9A:
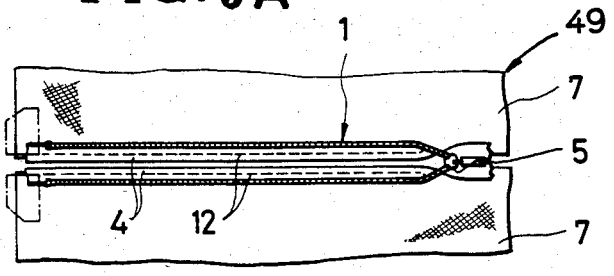
FIG 9A is a plan view of an ordinary slide fastener sewn to a pair of fabric pieces, with the opposed stringers uncoupled.

Subsequently, when the slider 5 disposed at the bottom end portion of the slide fastener 1 arrives at a non-illustrated slider detector mounted on the forward end of the slide fastener guide 17, the detector is pivotally moved upwardly to actuate a microswitch (not shown) associated therewith, whereupon the microswitch issues a command signal to the sewing machine 15 to start back-tucking. The sewing threads are cut and the presser foot 9 is then raised to terminate the operation of the sewing machine 15. As shown in FIG. 9A, the sewn stitches 12 extend from the leading end of the slide fastener 1 and terminate just short of the slider 5 disposed at the bottom end portion of the slide fastener 1, thus leaving the bottom end portions of the opposed stringers 4,4 not sewn, and hence floating, from the fabric pieces 7,7.

After the sewinq operation of the sewing machine 1 is stopped, the gripper mechanism 18 continues to discharge the sewn product 49 that has been removed from the sewing station 14.

Figure 8C:
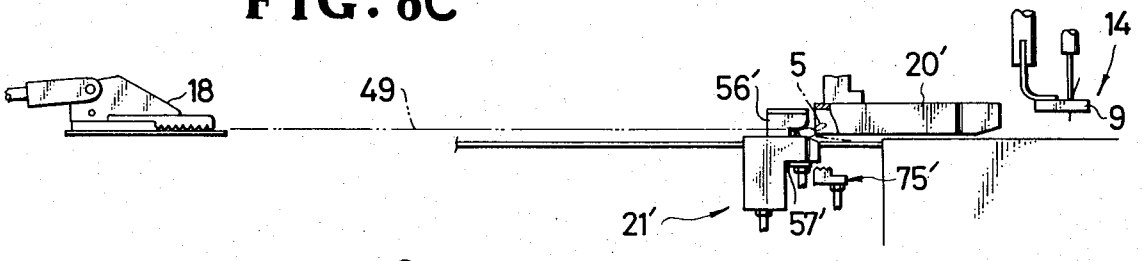

With continued discharging of the sewn product 49 by the gripper mechanism 18, the bottom end portion of the sewn slide fastener 1, including the slider 5, is introduced into the sewn-product guide 20'. Then the slider 5 of the sewn slide fastener 1 is blocked or caught by the slider catch 56' of the slider-moving unit 21', as shown in FIG. 8C. This blocking is detected by a photosensor (not shown) which then issues a command signal to energize the second air cylinder 59' (FIGS. 6B and 6C), causing the retainer 57' to raise to hold the slider body 5 against the catch 56'.

Upon receipt of the slider 5 in the catch 56', the forward movement of the gripper mechanism 18 is stopped and the operation of the brake 75' is started. Thus the leading end of the sewn product 49 is held in position by the grippers 29,29 and the bottom end portion of the slide fastener 1 is held in position by the brake 75' (FIG. 7C), giving the slide fastener 1 a constant tension.

Figure 8D:
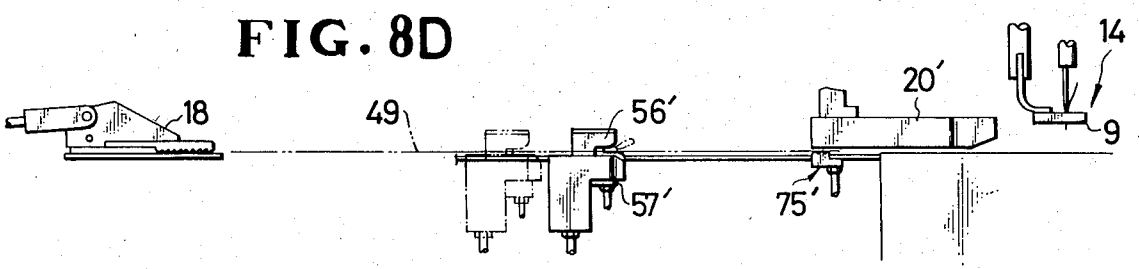

While the sewn product 49 is thus kept from moving, as shown in FIG. 8D, the slider-moving unit 21' is moved fowardly by the action of the drive 67' (FIG. 3) to pull the slider 5 along the uncoupled stringers 4,4 to partially close the sewn slide fastener 1. This pulling continues until the slider 5 is moved into the region where each stringer 4 and the corresponding fabric piece 7 are sewn together. Then the retainer 57' is returned to its original or retracted position (phantom lines in FIG. 8D) to release the slider 5 and the slider catch 56' is retracted below the table 13 (FIG. 8E), during which time the brake 75' continues to be operative.

Figure 8E:
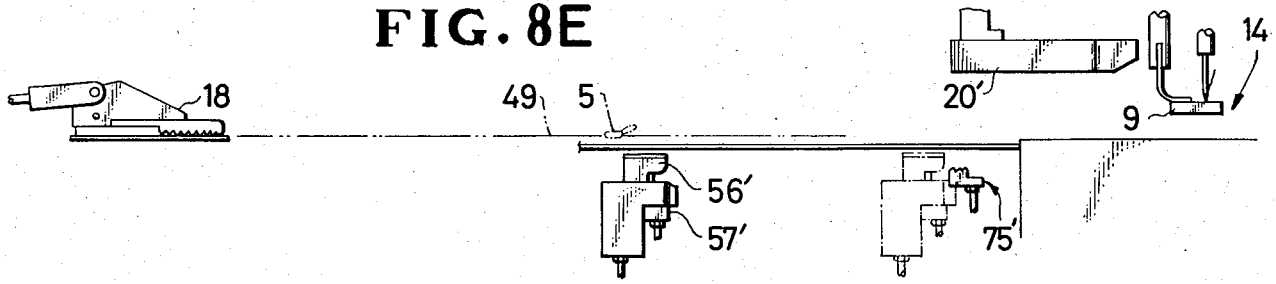

Thereafter, as shown in FIG. 8E, the brake 75' is rendered inoperative to release the trailing end of the sewn product 49, while the gripper mechanism 18 continues to discharge the sewn product 49. More specifically, in discharging the sewn product 49, when the contact member 48 on the slide 41 of the gripper mechanism 18 hits the actuator of the microswitch 47, a command signal is issued from the switch 47 to stop the servo motor driving the endless belt 44. The discharging of the sewn product 49 of the gripper mechanism 18 is terminated. Then the connector 31 is pivotally moved on the slide, 41 to extend downwardly during which time the stacker 19 is pivotally moved, by the action of the air cylinder 52, forwardly of the base beneath the table 13, as shown in FIG. 2. The grippers 29 at the end portion of the connector 31 are opened to release the sewn product 49, which thus falls onto the transverse pipe 50 of the stacker 19. The stacker 19 and the gripper mechanism 18 are returned to their original or upstream positions. The slider-moving unit 21' is also returned to its original or upstream position near the stations 14, during which time the slider-moving unit 21' remains retracted below the table 13. The product guide 20' is returned to its raised position. Thus a single cycle of the sewing operation has been completed and now the apparatus is in condition for start of the next cycle of the sewing operation.

Figure 9B:
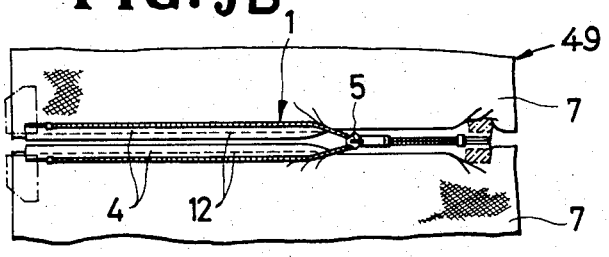
FIG. 9B is a view similar to FIG. 9A, showing the slide fastener with the opposed stringers partially coupled.

FIG. 9B shows the sewn product 49 obtained by the apparatus. In this sewn product 49, since the slider 5 is disposed into the region where each fastener stringer 4 and the corresponding fabric piece 7 are sewn together, smooth and quick coupling of the opposed stringers 4,4 can be achieved simply by manually pulling the slider 5. Accordingly the present apparatus is particularly useful for the case in which a plurality of slide fasteners 1 are sewn to successive pairs of the fabric pieces 7,7, and in which the sewn product 49 is temporarily stacked and then supplied one after another to a finishing station where the opposed fasteners stringers 4,4 of each slide fastener 1 are completely coupled by moving the slider 5.

Since the slider-moving unit 21' is retractable below the top surface of the table 13 so as not to interfere with the gripper mechanism 18, it is possible to sew a plurality of slide fasteners 1 successively to successive pairs of fabric pieces 7,7 without impeding the sewing and discharging operations.

An advantage of the slider-moving unit 21' is that because the slider catch 56' and the retainer 57' are moved vertically, an adequate horizontal stroke of the slider-moving unit 21' can be achieved, thus causing an improved rate of production. With this arrangement, the slider-moving unit 21' is particularly useful in the case where the sewn products 49 are relatively short, in which case the horizontal stroke of the gripper mechanism 18 must be short and the the slider catch 56' must start raising to project into the patch of the sewn product 49 without delay after the gripper mechanism 18 has passed over the catch 56'. Further, the slider-moving unit 21' is simple in construction and hence inexpensive to manufacture.

Figure 10A:
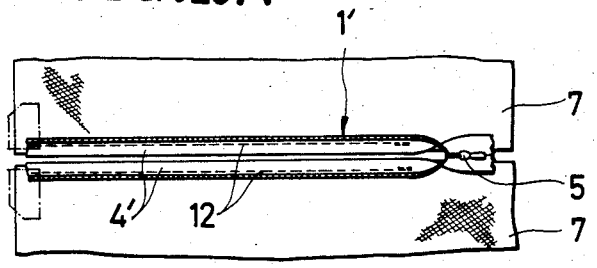
FIG. 10A is a plan view of a concealed slide fastener sewn to a pair of fabric pieces, with the opposed stringers uncoupled.
Figure 10B:
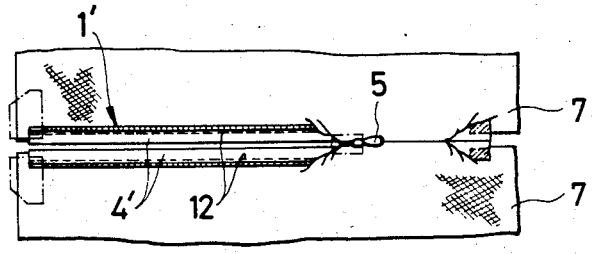
FIG. 10B is a view similar to FIG. 10A, showing the concealed slide fastener with the opposed stringers partially coupled.

FIG. 10A is a view similar to FIG. 9A showing a concealed slide fastener 1' sewn to a pair of fabric pieces 7,7 by the illustrated apparatus, with a pair of opposed stringers 4',4' partially coupled by the slider-moving unit 21'.

Although various minor modifications may be suggested by those versed in the art, it should be understood that I wish to embody within the scope of the patent warranted hereon, all such embodiments as reasonably and properly come within the scope of my contribution to the art.

What is claimed is:

1. In an apparatus for sewing a slide fastener to a pair of fabric pieces, the slide fastener including a pair of stringers and a slider slidable on and along the stringers for opening and closing the slide fastener, the apparatus including a sewing station defined by a double-needle sewing machine mounted on a table, and a gripper mechanism disposed downstream of the sewing station and reciprocable along a first horizontal path for gripping a top end portion of the slide fastener sewn to the pair of fabric pieces and for drawing the same from the sewing station, a slider-moving unit comprising:

(a) a slider-holding mechanism disposed downstream of said sewing station and reciprocable for pulling the slider away from the sewing station, said slider-holding mechanism including (1) a slide disposed below the first horizontal path and reciprocable along a second horizontal path parallel thereto, (2) a slide catch carried on said slide and vertically movable between a raised position in which it projects into said first horizontal path for receiving the slider and a lowered position in which said slider catch is retracted from said first horizontal path, and (3) a retainer carried on said slide catch and vertically movable with respect thereto for pressing the slider against said slider catch; and (b) a brake disposed adjacent to an upstream end of the reciprocating movement of said slider-holding mechanism for holding a bottom end portion of the slide fastener while the slider is being pulled by said slider-holding mechanism.

2. A slide-moving unit according to claim 1, including: a first vertical air cylinder fixedly secured to said slide and having a piston rod on which said slider catch is mounted; and a second vertical air cylinder fixedly secured to said slider catch and having a piston rod on which said retainer is mounted.

* * * * *